US006398520B2

(12) United States Patent
Han

(10) Patent No.: US 6,398,520 B2
(45) **Date of Patent: *Jun. 4, 2002**

(54) DISCHARGE MUFFLER OF A HERMETIC ROTARY COMPRESSOR

(75) Inventor: Chang-ju Han, Suwon (KR)

(73) Assignee: Samsung Electronics Co., Ltd., Suwon (KR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/239,142

(22) Filed: Jan. 28, 1999

(30) Foreign Application Priority Data

Jan. 14, 1999 (KR) ..... 99-754

(51) Int. Cl.[7] ..... F04B 39/00

(52) U.S. Cl. ..... 417/312; 62/296; 181/403; 181/902

(58) Field of Search ..... 62/296; 417/312; 181/198, 207, 212, 224, 264, 282, 236, 403, 902

(56) References Cited

U.S. PATENT DOCUMENTS

| | | | | |
|---|---|---|---|---|
| 1,691,305 A | * | 11/1928 | Replogle | 62/470 |
| 1,918,149 A | * | 7/1933 | Sullivan | 428/132 |
| 2,557,687 A | * | 6/1951 | Rainville | 181/70 |
| 3,107,484 A | * | 10/1963 | Touhey | 181/212 |
| 4,557,349 A | * | 12/1985 | Crump | 181/279 |
| 4,601,644 A | * | 7/1986 | Gannaway | 417/902 |

FOREIGN PATENT DOCUMENTS

| | | |
|---|---|---|
| JP | 48-108026 | 3/1972 |
| JP | 57-068113 | 10/1980 |
| JP | 60-180708 | 11/1985 |

* cited by examiner

*Primary Examiner*—Charles G. Freay
*Assistant Examiner*—William Rodriguez
(74) *Attorney, Agent, or Firm*—Robert E. Bushnell, Esq.

(57) ABSTRACT

A discharge muffler of a hermetic rotary compressor has a simple structure, and reduces the noises which occur due to pulsation of refrigerant and impact to a valve when the refrigerant, which is compressed in an inner space of a cylinder of the compressor, is discharged. The discharge muffler includes a muffler body which is disposed above an upper flange to define a noise reducing space with the upper flange, and has a pair of discharge openings through which the refrigerant, which is discharged to the noise reducing space, is discharged, and a phase varying means for preventing the noises which occur due to the pulsation of the refrigerant and the impact to the valve which is disposed at the discharge port, from being discharged together with the refrigerant. The phase varying means also functions to vary the phases of the noises and to counterbalance the noises. The phase varying means comprises a pair of covers which extend from the muffler body toward centers of the discharge openings to cover approximately half portions of the discharge openings from above and from below, respectively, in an alternating pattern. Accordingly, the noise, which is produced when the refrigerant is discharged, is blocked by a pair of covers which are disposed at the discharge openings, and the phases of the noises are varied, so that the noises are counterbalanced. As a result, the great noise reduction effect is guaranteed with a simple structure.

31 Claims, 8 Drawing Sheets

DISCHARGE MUFFLER OF A HERMETIC ROTARY COMPRESSOR

CLAIM OF PRIORITY

This application makes reference to, incorporates the same herein, and claims all benefits accruing under 35 U.S.C. §119 from my application DISCHARGE MUFFLER OF A HERMETIC ROTARY COMPRESSOR filed with the Korean Industrial Property Office on Jan. 14, 1999 and there duly assigned Serial No. 754/1999.

BACKGROUND OF THE INVENTION

1. Field of the Invention

The present invention relates to a hermetic rotary compressor which constitutes a refrigerating cycle of an air conditioner, a refrigerator, or the like, and more particularly to a discharge muffler for reducing noises which occur due to pulsation of refrigerant and impact to a valve when the refrigerant, which is compressed in a cylinder, is discharged.

2. Description of the Prior Art

Generally, a hermetic compressor comprises a compression unit, and a motor for driving the compression unit, which are installed within a sealed casing. Such a hermetic compressor is usually classified according to the operation type of compression unit, into a reciprocating type compressor, a scroll type compressor, and a rotary type compressor.

Among these, FIG. 1 shows a rotary type compressor which has a relatively superb performance in comparison with its simple structure.

FIG. 1 is a vertical sectional view of a conventional hermetic rotary compressor, in which the reference numeral 10 refers to a sealed casing, 20 refers to a motor, and 30 refers to a compression unit.

As shown in FIG. 1, the compression unit 30 comprises a pair of flanges 32 and 34 for supporting an eccentric shaft 22 of the motor, a cylinder 36 which is disposed between the flanges 32 and 34, and a roller 38 which surrounds the eccentric shaft 22.

The refrigerant which is sucked into an inner space defined by the cylinder 36 through a suction port 52, is compressed by the rotational movement of the roller 38. The compressed 25 refrigerant is discharged into an inner space of the sealed casing 10 through a discharge port 33 which is formed on the upper flange 32.

The reference numeral 40 in FIG. 1 refers to a discharge muffler. The discharge muffler 40 functions to reduce the noise which occurs due to the pulsation of the refrigerant and the noise which occurs due to the impact to a valve 39 when the refrigerant is discharged through the discharge port 33. Such the discharge muffler 40 is in such a shape that is shown in FIGS. 2 and 3, and is disposed above the upper flange 32 to define a noise reducing space with the upper flange 32, so that the noise reducing space is defined between the discharge muffler 40 and the upper flange 32. Accordingly, the refrigerant is discharged through the discharge port 33 to the noise reducing space, and then discharged into the inner space of the sealed casing 10 through a pair of discharge openings 42 which are formed on the discharge muffler 40. In such a situation, the noise, which is produced while the refrigerant is discharged, is reduced while the refrigerant is expanded in the discharge muffler 40. As described, the purpose of employing the discharge muffler 40 is to reduce the noise. In FIG. 1, the reference numeral 60 refers to an accumulator.

In the conventional discharge muffler, however, since the refrigerant, which is discharged into the noise reducing space, is directly discharged through the discharge openings, the noise from the pulsation of refrigerant and the impact to the valve are not reduced, satisfactorily.

Further, in the conventional hermetic rotary compressor, since the oil for lubricating the eccentric shaft 22 is discharged together with the refrigerant when the refrigerant is discharged through the discharge port 33, and since there is no separate device for suppressing the amount of discharged oil, the amount of discharged oil increases while the amount of discharged refrigerant decreases. Accordingly, the efficiency of the compressor is deteriorated.

A Japanese Patent Laid-Open No. 2-61375 discloses a noise reducing device of a hermetic compressor, which overcomes the above-described problems of the prior art, and is shown in FIGS. 4 and 5.

As shown in FIGS. 4 and 5, the noise reducing device of the hermetic compressor has a connecting pipe 44' which is disposed at a lower side of the discharge opening 42' of the discharge muffler 40'. The connecting pipe 44' serves as a resonance device to reduce the noise. The hermetic compressor, however, has a disadvantage in that the structure and manufacturing process thereof are complex.

SUMMARY OF THE INVENTION

The present invention has been developed to overcome the above-mentioned problem of the prior art, and accordingly, it is an object of the present invention to provide a discharge muffler of a hermetic rotary compressor which has a simple structure and reduces the noises which occur due to the pulsation of the refrigerant and the impact to the valve when the refrigerant is discharged.

The above object will be accomplished by the discharge muffler according to the present invention which comprises a muffler body, and a phase varying means. The muffler body is disposed above an upper flange having a refrigerant discharge port to define a noise reducing space with the upper flange. The muffler body has a pair of discharge openings. The phase varying means blocks the noises which occur due to the pulsation of the refrigerant and the impact to a valve when the refrigerant is discharged. Here, the valve is disposed at a discharge port. The phase varying means prevent the noises which occurs due to the pulsation of the refrigerant and the impact to the valve, from being discharged together with the refrigerant. The phase varying means also counterbalances the noises by varying the phases of the noises.

The phase varying means comprises a pair of covers which extend from the muffler body toward the center of the discharge opening. The covers cover approximately half portion of the discharge opening from above and from below, respectively, in an alternating pattern.

Here, the phase varying means is formed at a pair of discharge openings, respectively, and has such an arrangement that permits the refrigerant to be discharged in the circumferential direction of the muffler body.

Further, a pair of covers can be designed either in a hemispheric shape, or in a semi-oval shape, or in any shape only if it is of spheric shape.

Accordingly, the noise which is produced while the refrigerant is discharged, is blocked by the phase varying means, and simultaneously, the phases of the noises are varied so that the noises are counterbalanced. As a result, the great noise reduction effect is guaranteed with a simple structure.

BRIEF DESCRIPTION OF THE DRAWINGS

The above objects and advantages will be more apparent by describing the present invention with reference to the accompanied reference drawings, in which.

DETAILED DESCRIPTION OF THE PREFERRED EMBODIMENT

Figure 6:
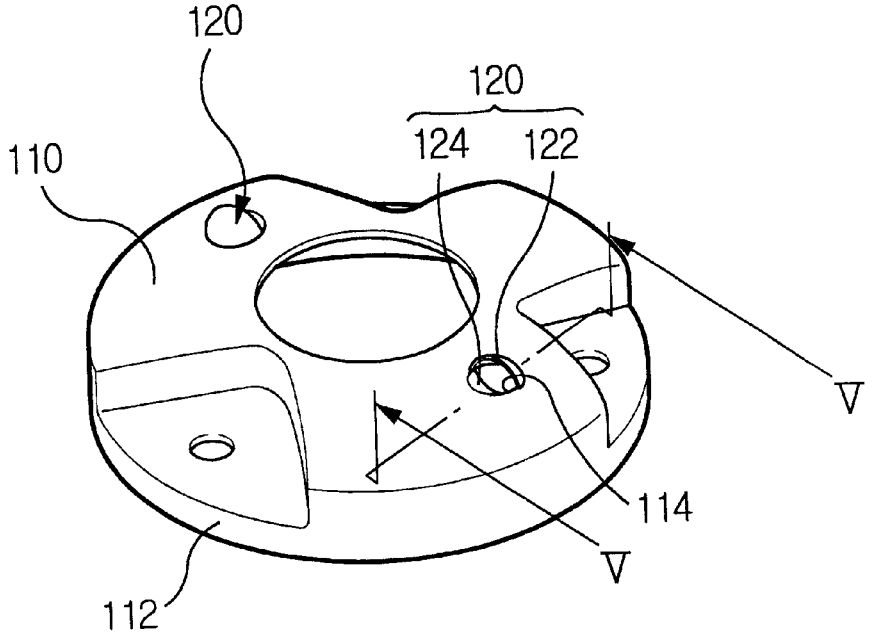
FIG. 6 is a perspective view for showing the structure of the discharge muffler according to a preferred embodiment of the present invention.
Figure 7:
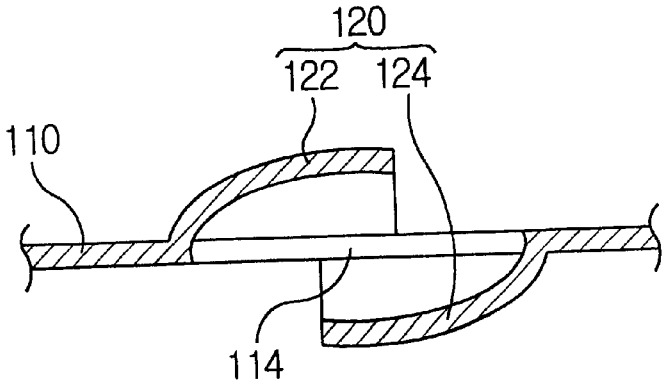
FIG. 7 is a sectional view taken on line V—V of FIG. 6.
Figure 8:
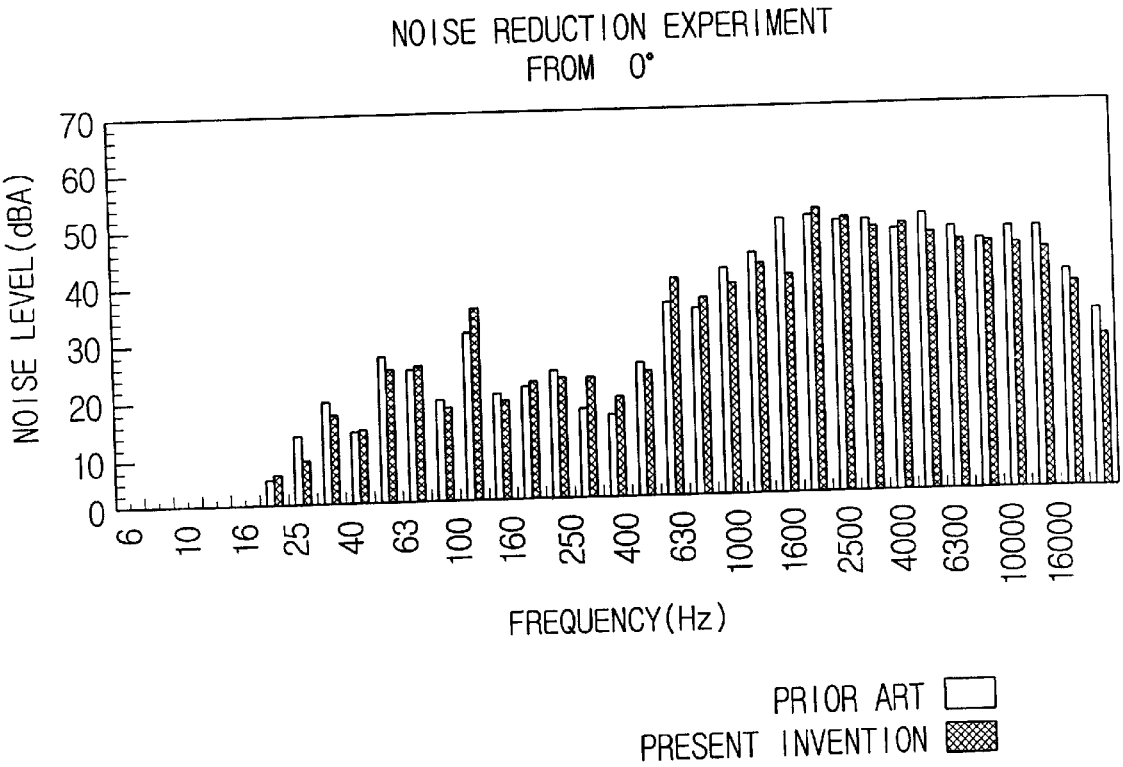
FIGS. 8 through 11 are graphs for illustrating the noise reduction results of experiments which were conducted on the discharge muffler according to the preferred embodiment of the present invention, from the directions of 0°, 90°, 180°, 270° with respect to the hermetic rotary compressor.
Figure 9:
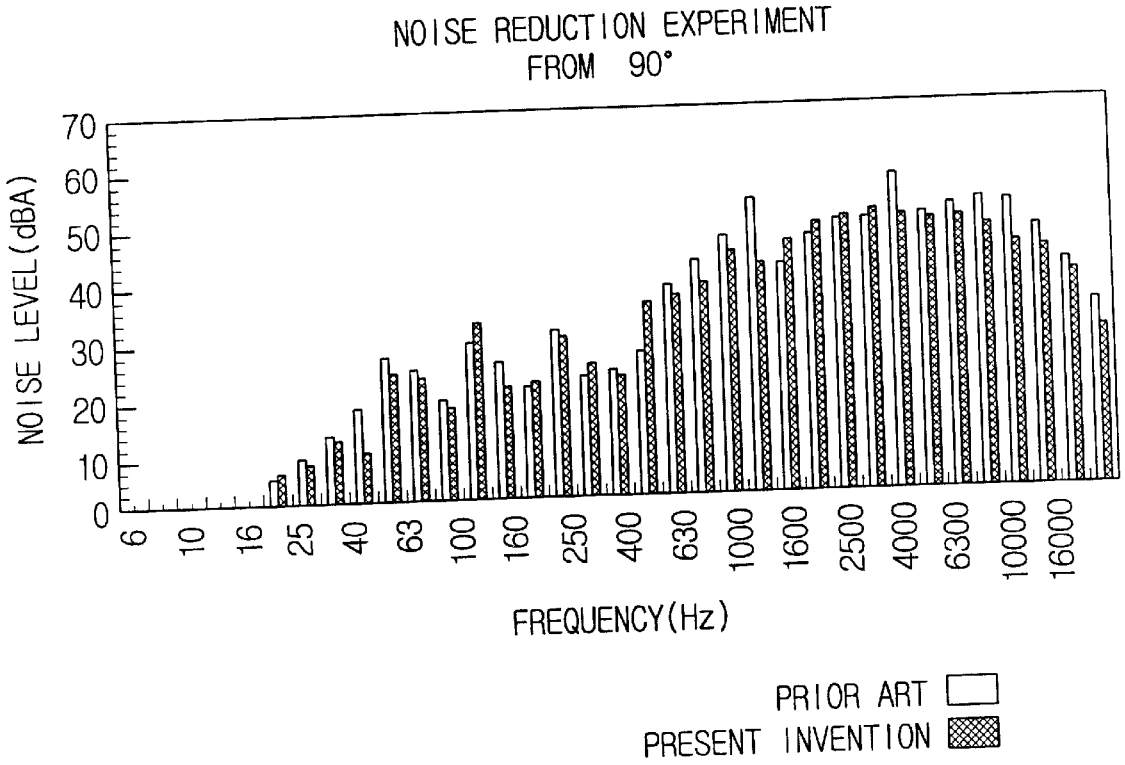
Figure 10:
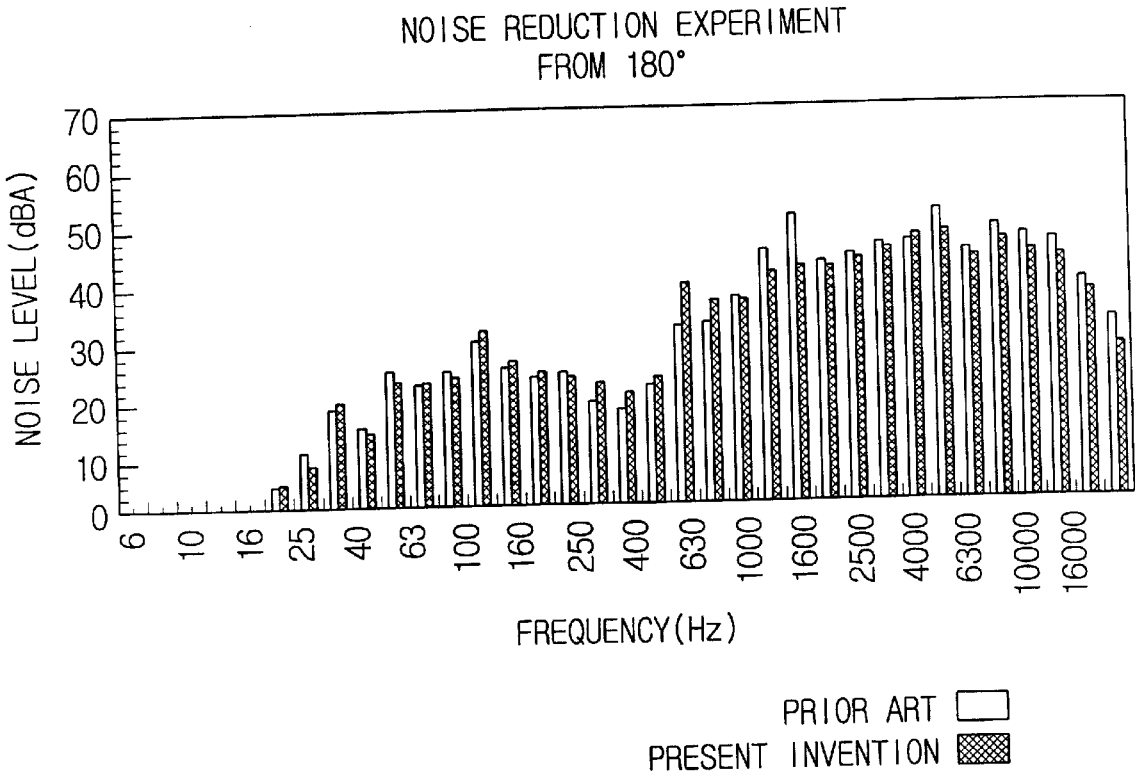
Figure 11:
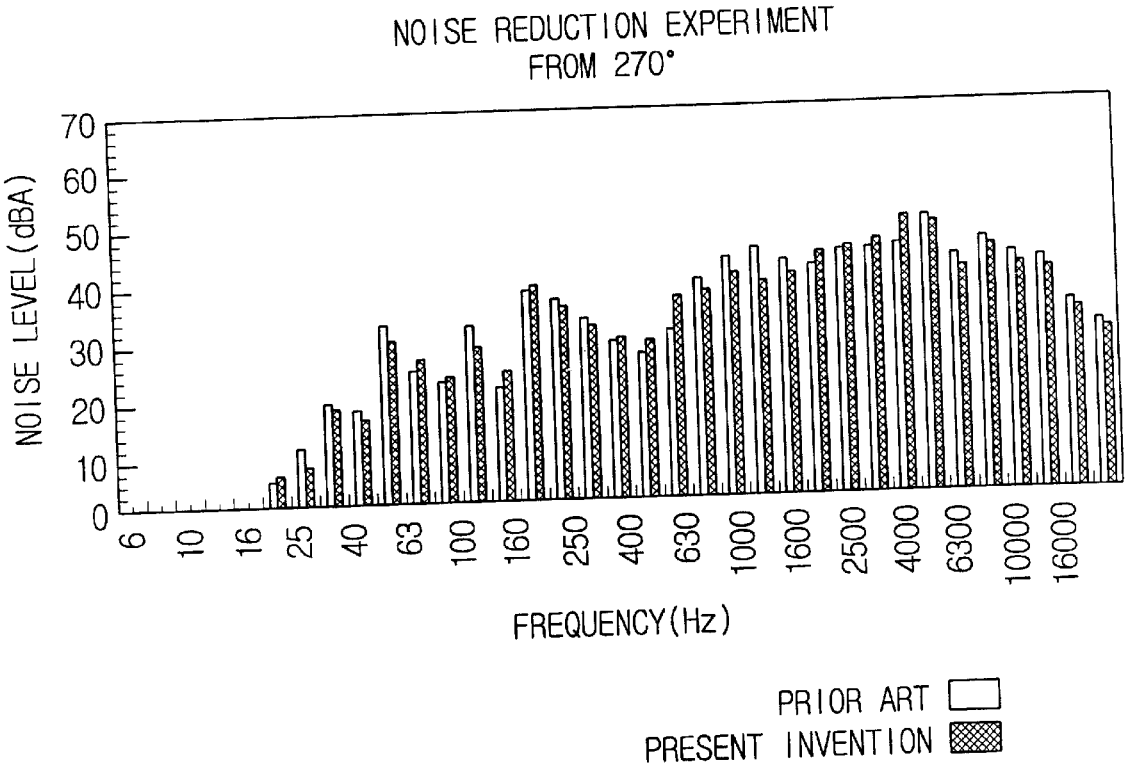

FIG. 6 shows a discharge muffler of a hermetic rotary compressor according to the preferred embodiment of the present invention. FIG. 7 is a sectional view taken on line V—V of FIG. 6 which shows the main portion of a phase varying means, the main aspect of the present invention, in greater detail. In the figures, the reference numeral 110 is a muffler body, and 120 is a phase varying means.

Figure 1:
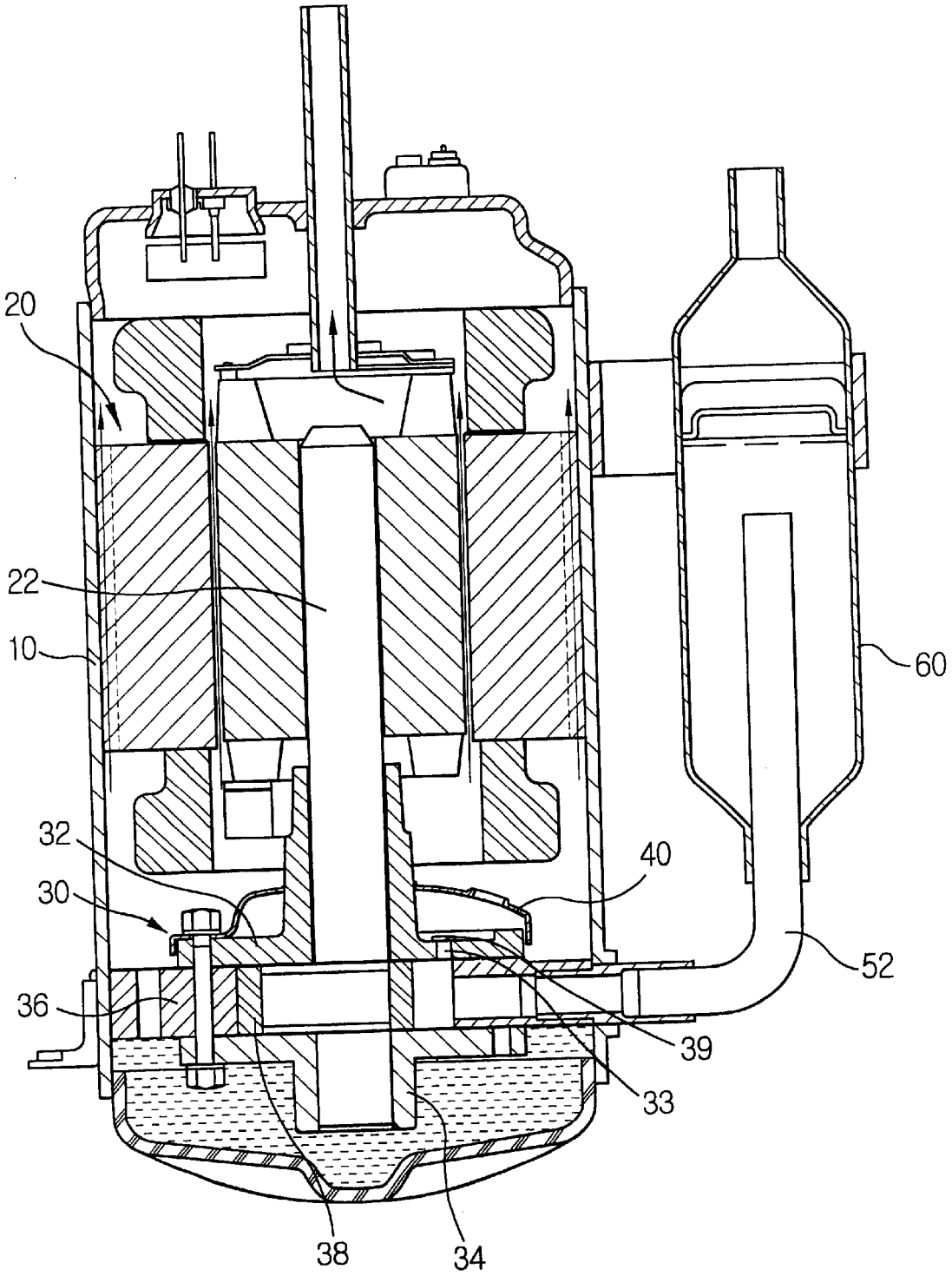
FIG. 1 (PRIOR ART)
FIG. 1 is a vertical sectional view of a conventional hermetic rotary compressor.
Figure 2:
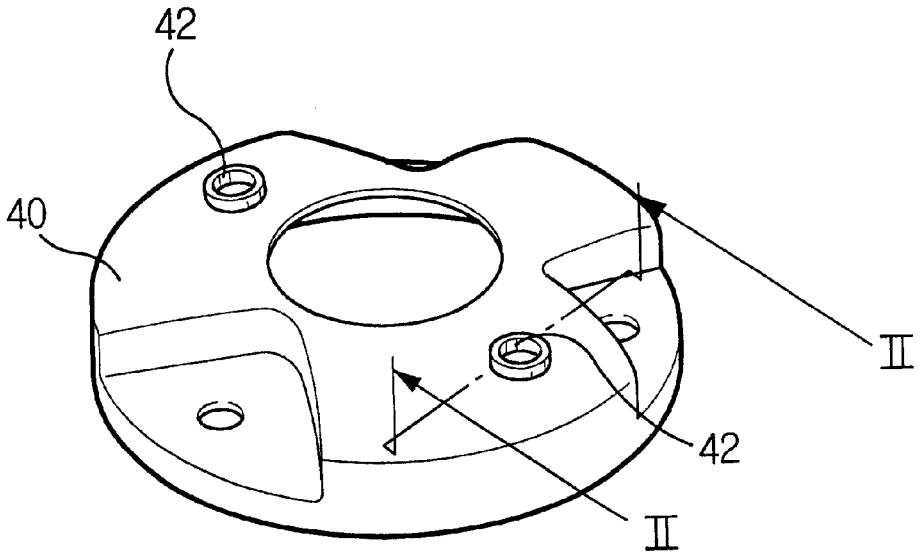
FIG.2 (PRIOR ART)
FIG. 2 is a perspective view for showing the structure of a conventional discharge muffler.
Figure 3:
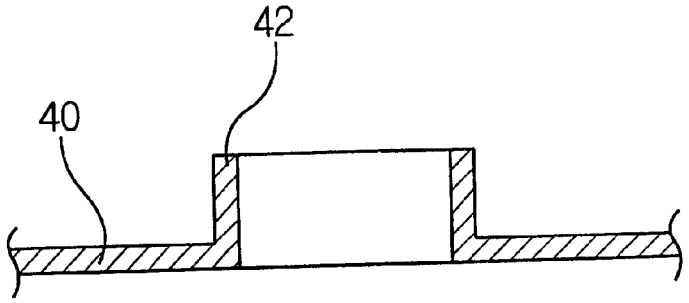
FIG.3 (PRIOR ART)
FIG. 3 is a sectional view taken on line II—II of FIG. 2.
Figure 4:
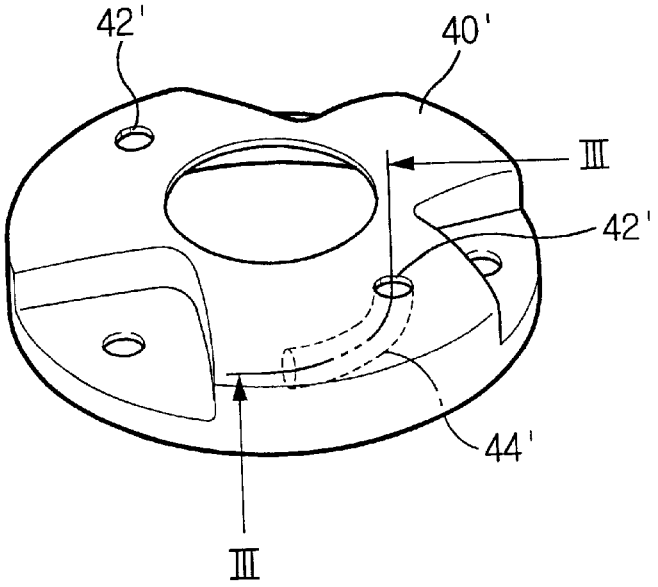
FIG.4 (PRIOR ART)
FIG. 4 is a perspective view for showing the structure of another conventional discharge muffler.
Figure 5:
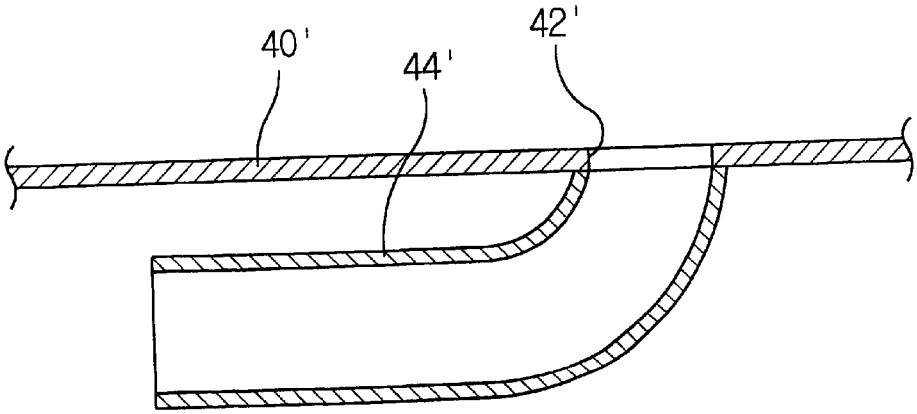
FIG.5 (PRIOR ART)
FIG. 5 is a sectional view taken on line III—III of FIG. 4.

As shown, the muffler body 110 comprises a skirt plate 112 which extends downward along the circumference of the muffler body 110. As shown in FIG. 1, the muffler body 110 is disposed above an upper flange 32 which has a discharge port 33. Accordingly, a noise reducing space is defined between the muffler body 110 and the upper flange 32. Additionally, a pair of discharge openings 114 are formed on the muffler body 110, to discharge the refrigerant of the noise reducing space out (into the inner space of the sealed casing). A pair of discharge openings 114 are disposed opposite each other.

The phase varying means 120 is formed at the respective discharge openings 114 of the muffler body 110. The phase varying means 120 comprises an upper cover 122, and a lower cover 124. The upper cover 122 extends from the muffler body 110 toward the center of the discharge opening 114 to cover approximately a half portion of the discharge opening 114 from above. The lower cover 124 extends from the muffler body 110 toward the center of the discharge opening 114 to cover approximately a half portion of the discharge opening 114 from below, in an alternating position with respect to the upper cover 122.

As shown in FIG. 7, the upper and lower covers 122 and 124 are in the shape of an arc. More specifically, the upper and lower covers 122 and 124 may be designed either in a hemispheric shape, or in a semi-oval shape, or in any shape if it is of a spheric shape. Further, a pair of phase varying means 120 have such an arrangement that permits the refrigerant to be discharged in the circumferential direction of the muffler body 110. Preferably, the direction toward which the refrigerant is discharged is that toward which the motor is rotated.

By the phase varying means 120 which has the above-described structure, each of the discharge openings 114 define a passageway which has a predetermined angle, and the compressed refrigerant is discharged through the passageway. In such a situation, the noises which are produced while the refrigerant is discharged, are blocked by the phase varying means 120. Accordingly, the noises are not discharged through the discharge openings 114 directly, but reflected within the noise reducing space repeatedly and discharged out through the discharge openings 114, gradually. While the noises are reflected, the phases of the noise wavelengths are varied, and the wavelengths of the noises which have different phases interfere with each other, so that the wavelengths of the noises are counterbalanced. As a result, the noise is reduced.

FIGS. 8 to 11 are graphs for illustrating the noise reduction results of experiments which were conducted on the discharge muffler according to the preferred embodiment of the present invention in comparison with the conventional discharge muffler, from the directions of 0°, 90°, 180°, 270° with respect to the hermetic rotary compressor.

According to the graphs, among the noises which are produced at the compressor, the noise of frequency of 1000 Hz—2000 Hz, which is reducible through the discharge muffler, is reduced by a 10 dB. As a result, the compressor can have a noise reduction effect of approximately 2 dB.

Further, by the phase varying means, the refrigerant, which is discharged into the noise reducing space, is prevented from being directly discharged. Also, by the phase varying means, the amount of oil, which is discharged together with the refrigerant through the discharge openings 114, is greatly reduced. Accordingly, the amount of discharged refrigerant increases in comparison with the amount of discharged oil, so that the efficiency of the compressor is improved.

As described above, according to the present invention, while the refrigerant is discharged, the noise is blocked by the phase varying means which is disposed at the discharge openings, and the phases of the noises are varied and the noises are counterbalanced. Accordingly, the superb noise reduction effect can be guaranteed with the simple structure.

Further, since the phase varying means functions to block the discharged oil, the amount of discharged oil is greatly reduced. Accordingly, the amount of discharged refrigerant increases while the amount of discharged oil decreases. As a result, the efficiency of the compressor is improved.

While the present invention has been particularly shown and described with reference to the preferred embodiment thereof, it will be understood by those skilled in the art that various changes in form and details may be effected therein without departing from the spirit and scope of the invention as defined by the appended claims.

What is claimed is:

1. A discharge muffler of a hermetic rotary compressor having a cylinder, comprising:

a muffler body disposed above an upper flange of said cylinder to define a noise reducing space with the upper flange, having an opening, on said muffler body, wherein refrigerant contained in said noise reducing space is discharged from said noise reducing space to outside of said muffler body through said opening;

a first cover extending from one edge portion of said opening on the muffler body towards the center of said opening, wherein said first cover covers approximately a half portion of said opening from above said muffler body; and a second cover extending from the edge of a second portion of said opening on the muffler body towards the center of said opening, wherein said second covers approximately one-half of the opening from below said muffler body.

2. The discharge muffler as claimed in claim 1, with said muffler body comprising at least two openings each having a first said cover and a second said cover.

3. The discharge muffler as claimed in claim 2, wherein said first cover permits the refrigerant to be discharged through said opening in a circumferential direction to said muffler body.

4. The discharge muffler as claimed in claim 1, wherein said first cover and said second cover are hemispheric in shape.

5. The discharge muffler as claimed in claim 1, wherein said first cover and said second cover are semi-oval in shape.

6. The muffler of claim 1, comprising said first cover and said second cover being slightly smaller than one-half of said opening.

7. The muffler of claim 1, comprising said first cover and said second cover being slightly larger than one-half of said opening.

8. A discharge muffler body attached to an upper flange of a cylinder in a hermetic rotary compressor, further comprising:

an opening formed on said muffler body;

a first cover extending from an edge of said opening towards and above the center of said opening, and partially obscuring a first side of said opening; and a second cover extending in a direction opposite to said first coffer with respect to said opening, from an edge on a second side of said opening towards the center of said opening, and partially obscuring said second side by said second cover;

wherein said second side is planarly opposite from said first side.

9. The muffler of claim 8, with said first cover comprising a portion rising away from a plane defined by a periphery of said opening.

10. The muffler of claim 8, with said second cover comprising a portion rising away from a plane defined by a periphery of said opening.

11. The muffler of claim 8, further comprising:

a first portion formed on said first cover to rise away from a periphery of said opening; and a second portion formed on said second cover to rise away from said periphery of said opening.

12. The muffler of claim 11, further comprised of an interior of said first portion facing an interior of said second portion through said opening.

13. The muffler of claim 12, further comprised of said first portion disposed on said first side of said opening while said second portion is disposed on said second side of said opening.

14. The muffler of said claim 8, with said first cover rising away from a plane defined by a periphery of said opening.

15. The muffler of said claim 14, wherein said first cover permits a refrigerant to be discharged through said opening in a circumferential direction to said muffler body.

16. The muffler of said claim 8, with said first cover disposed on the first side of said opening while said second cover is disposed on the second side of said opening.

17. The muffler of said claim 8, further comprised of said first cover and said second cover having any one of a hemispheric shape and a semi-oval shape.

18. The muffler of said claim 8, wherein said first cover and said second cover have an offset portion.

19. The muffler of said claim 8, wherein said first cover, said second cover and said muffler are formed in a single integrated and monolithic structure.

20. The muffler of claim 8, comprising said first cover and said second cover being slightly smaller than on-half of said opening.

21. The muffler of claim 8, comprising said first cover and said second cover being slightly larger than one-half of said opening.

22. A method in a compressor having a cylinder, comprising the steps of:

providing a discharge port formed on an upper flange of said cylinder, a discharge muffler attached to said upper flange and accommodating discharge of a refrigerant from said discharge port of said upper flange of said cylinder, and a noise reducing space defined between said discharge muffler and said upper flange;

forming an opening on said discharge muffler, a first cover extending from an edge on a first side of said opening towards and above the center of said opening and partially obscuring said first side of said opening, and a second cover extending in a direction opposite to said first cover with respect to said opening, from an edge on a second side of said opening towards the center of said opening, and partially obscuring said second side by said second cover, wherein said second side is planarly opposite said first side; and allowing the refrigerant to pass through said opening and between said first cover and said second cover of said discharge muffler and to be discharged outside of said discharge muffler from said noise reducing space in a direction along an outer surface of said discharge muffler.

23. A discharge muffler of a hermetic rotary compressor having a cylinder, further comprising:

an upper flange formed on said cylinder;

a discharge port formed on said upper flange accommodating discharge of refrigerant from said cylinder;

a muffler body disposed above said upper flange of said cylinder to define a noise reducing space with the upper flange, said muffler body having an opening thereon, wherein the refrigerant contained in said noise reducing space is discharged from said noise reducing space to outside of said muffler body through said opening;

a first cover extending from an edge of a first side of said opening of the muffler body towards and above the center of said opening and covering approximately a half portion of said opening; and a second cover extending from an edge of a second side of said opening opposite to said first side of said opening towards and below the center of said opening in a direction opposite to said first cover with respect to said opening and covering approximately the other half portion of said opening.

24. The discharge muffler as claimed in claim 23, with said muffler body comprising at least two openings each having a first said cover and a second said cover.

25. The discharge muffler as claimed in claim 24, wherein said first cover permits the refrigerant to be discharged through said opening in a circumferential direction to said muffler body.

26. The discharge muffler as claimed in claim 23, wherein said first cover and said second cover are hemispheric in shape.

27. The discharge muffler as claimed in claim 23, wherein said first cover and said second cover are semi-oval in shape.

28. A discharge muffler attached to an upper flange of a cylinder in a hermetic rotary compressor, further comprising:

a discharge port formed on said upper flange, accommodating discharge of a refrigerant from said cylinder;

a muffler body disposed above said upper flange of said cylinder to define a noise reducing space with said upper flange;

an opening formed on said muffler body wherein the refrigerant contained in said noise reducing space is discharged from said noise reducing space to outside of said muffler body through said opening;

a first cover extending from an edge of said opening towards and above the center of said opening, and partially obscuring a first side of said opening; and a second cover extending in a direction opposite to said first cover with respect to said opening, from an edge on a second side of said opening towards the center of said opening, and partially obscuring said second side by said second cover;

wherein said second side is planarly opposite from said first side.

29. The muffler of claim 28, with said first cover comprising a portion spaced-apart from a plane of said opening.

30. The muffler of claim 28, with said second cover comprising a portion spaced-apart from a plane of said opening.

31. The muffler of claim 28, further comprising:

a first portion formed on said first cover and spaced-apart from said opening; and a second portion formed on said second cover and spaced-apart from said opening.

* * * * *